US007357175B2

(12) United States Patent
Bader

(10) Patent No.: US 7,357,175 B2
(45) Date of Patent: Apr. 15, 2008

(54) HEATING ELEMENT

(75) Inventor: Silvia Bader, Munich (DE)

(73) Assignee: Jessica Hasler, Zurich (CH)

( * ) Notice: Subject to any disclaimer, the term of this patent is extended or adjusted under 35 U.S.C. 154(b) by 0 days.

(21) Appl. No.: 10/522,422

(22) PCT Filed: Jul. 28, 2003

(86) PCT No.: PCT/DE03/02536

§ 371 (c)(1),
(2), (4) Date: Sep. 12, 2005

(87) PCT Pub. No.: WO2004/015353

PCT Pub. Date: Feb. 19, 2004

(65) Prior Publication Data

US 2006/0131004 A1 Jun. 22, 2006

(30) Foreign Application Priority Data

Jul. 26, 2002 (DE) ..... 202 11 325 U

(51) Int. Cl.
*F28F 13/18* (2006.01)

(52) U.S. Cl. ..... 165/133; 165/904

(58) Field of Classification Search ..... 165/133
See application file for complete search history.

(56) References Cited

U.S. PATENT DOCUMENTS 4,148,453 A * 4/1979 Brantly ..... 248/660
4,521,463 A * 6/1985 Powers et al. ..... 427/435
4,589,351 A * 5/1986 Love ..... 108/164
4,789,026 A * 12/1988 Shank et al. ..... 165/104.26
5,056,126 A * 10/1991 Klostermann et al. ..... 378/127
5,548,100 A * 8/1996 Miller ..... 219/521
6,365,276 B1 * 4/2002 Rudisi et al. ..... 428/412
6,935,279 B2 * 8/2005 Bosworth ..... 122/4 R

FOREIGN PATENT DOCUMENTS

| | | |
|---|---|---|
| DE | 198 54 089 | 5/2000 |
| FR | 2695466 | 3/1994 |
| GB | 596135 | 12/1947 |
| GB | 2365114 | 2/2002 |
| JP | 62152627 A * | 7/1987 |
| JP | 4126902 | 4/1992 |

OTHER PUBLICATIONS

"Properties of Aluminum and Aluminum Alloys", from the Key to Metals website, located at: http://www.keytononferrous.com/Articles/Article142.htm copyright 1999-2005 by INI International.*

* cited by examiner

*Primary Examiner*—Allen J. Flanigan
(74) *Attorney, Agent, or Firm*—Hooker & Habib, P.C.

(57) ABSTRACT

The invention relates to a heating element comprising a base body (4) made of metal, preferably aluminum or stainless steel, the surface (10) of which is highly polished and corrosion resistant.

1 Claim, 1 Drawing Sheet

HEATING ELEMENT

FIELD OF THE INVENTION

The invention relates to heating bodies, and in particular, to towel dryers for drying and warming towels.

BACKGROUND OF THE INVENTION

Towel dryers are used to dry and warm towels. A towel dryer has an outer surface that supports a towel to be dried. The surface is heated above room temperature, typically by flowing heated fluid through the dryer or by electrical heating.

It is believed that a towel dryer operates mainly by transferring heat to the towel by conduction and natural convection. Heat is transferred by conduction directly from the dryer surface to the portion of the towel in contact with the surface. Heat is also transferred indirectly from the towel dryer to the towel by natural convection, the towel dryer heating the surrounding air and the heated air transferring heat to the towel.

It is believed that at normal operating temperatures, radiant heat transfer is not an important mechanism in transferring heat from the towel dryer to the towel. However, heat can be lost from the towel dryer by such radiant heat transfer. Heat loss by radiant heat transfer wastes energy and lowers the efficiency of the towel dryer because radiant heat transfer cools the dryer surface without effectively contributing to warming and drying the towel. Reducing heat loss by radiant heat transfer would enable the towel dryer to be more energy efficient: the towel dryer could reach a higher operating temperature with the same energy input, or would reach the same operating temperature with reduced energy input.

Towel dryers are generally constructed of a base body of unalloyed steel with a surface coating, in order to attain certain desirable coloration appearances. In this practice, depending upon the location of the said towel dryer, different coating procedures are used. Thus it is possible, for example, that towel dryers in residential areas are provided with a powdery coating or they may be lacquered. Most likely a towel dryer in a bathroom can be electrically chromed.

The above described procedures and materials have the disadvantage, that the surface coating negatively affects the heating capacity of a steel towel dryer. The term "heating capacity" is related to the amount of energy that must be supplied to maintain the towel dryer at its operating temperature. A towel dryer with a higher heating capacity will maintain its operating temperature with less energy input than would a similar towel dryer with a lower heating capacity.

Thus, for example, an electrically chromed, steel towel dryer, as compared to a lacquered or powder covered steel towel dryer, will yield only 20 to 30% as much heat. This poor rendition of heat from chrome covered steel heating bodies results in the construction of very large heating bodies, which in turn, each disadvantageously require a large space allotment.

It is believed that a chromed steel body loses more heat by radiant heat transfer than a lacquered or powder covered steel body. This appears to be due to the higher emissivity of the chromed steel body as compared to the lacquered or powder covered steel body. The greater the emissivity a body has, the more efficient it is in losing heat by radiant heat transfer. The higher emissivity of the chromed steel body causes greater heat loss through radiant heat transfer, reducing the heating capacity of the body and reducing the energy efficiency of the towel dryer.

The purpose of the present invention is to create a towel dryer with a similar, highly reflective surface, which resembles a towel dryer having a chromed body, which sets aside the above named disadvantages and is further, simple and economical to produce. In other words, the purpose of the present invention is to provide a functionally more energy efficient towel dryer that retains a visually appealing, highly reflective body. The towel dryer would be capable of transferring a larger percentage of its heat by conduction or convection, and so could also be made smaller for the same rate of heat transfer to a towel.

SUMMARY OF THE INVENTION

The towel dryer in accord with the invention has a base body of metal, especially aluminum. The surface of the said invented base body is worked in such a manner, that a conventional electrically applied chrome coating or gilding, for the purpose of and bringing about a highly reflective surface, can be eliminated. Instead of aluminum, it is also possible to make use of any other metal, such as, for instance, a highly refined steel.

Highly polished aluminum may have an emissivity of about 0.04 or less, and highly polished stainless steel may have an emissivity of about 0.1, each significantly lower than the emissivity of chromed steel that may be about 0.17. A towel dryer made of highly polished aluminum or highly polished stainless steel would have less radiant energy loss and thus greater heating capacity and greater operating efficiency than would the same conventional towel dryer made of chromed steel.

In accord with the invention, the surface is then of high polish and possesses a degree of reflectivity of 80% to 100%. This provides a body having a sufficiently low emissivity to be more efficient than a conventional chromed steel towel dryer.

Because of the aluminum, that is to say a metallic, base body and the elimination of the electrical chrome application, the invented towel dryer has a substantially greater thermal efficiency than does a towel dryer having the conventional chromed, steel heating body. Thus, a conventional towel dryer, which possesses a chromed coating, when compared to an invented, highly polished towel dryer constructed of aluminum, exhibits a thermal efficiency which is about 30% to 40% less. In other words, the invented towel dryer, when operating at the same heating load, can clearly be made smaller and less expensively. This is a considerable advantage in bathrooms with predominately less available space.

For the achievement of the desired degree of burnish, the metal construction of the invented towel dryer base body is mechanically ground, mechanically polished and chemically and electrochemically polished.

One embodiment of the invented towel dryer advantageously possesses, for the purpose of increasing the resistance to corrosion and for the retention of the high degree of burnish, an electrochemically anodized surface or has an Eloxal coating. Plain anodized aluminum may have an emissivity of 0.04, which enables a towel dryer having polished aluminum surface to be anodized for corrosion resistance and yet retain a lower emissivity than a conventional chromed steel towel dryer.

Another embodiment provides, for the increase of resistance to corrosion, and for the retention of the high degree of burnish, a clear lacquer coating.

Intrinsically, known towel dryers with an aluminum base body are often chromed for the purpose of creating a highly reflective surface, which requires not only a complicated procedure and is expensive, but further, notably reduces the emission of heat, that is, notably reduces the heating capacity and energy efficiency of the towel dryer.

In the following, the invention is more closely described with the aid of an illustrated presentation of a preferred embodiment.

DESCRIPTION OF THE PREFERRED EMBODIMENT

Figure 1:
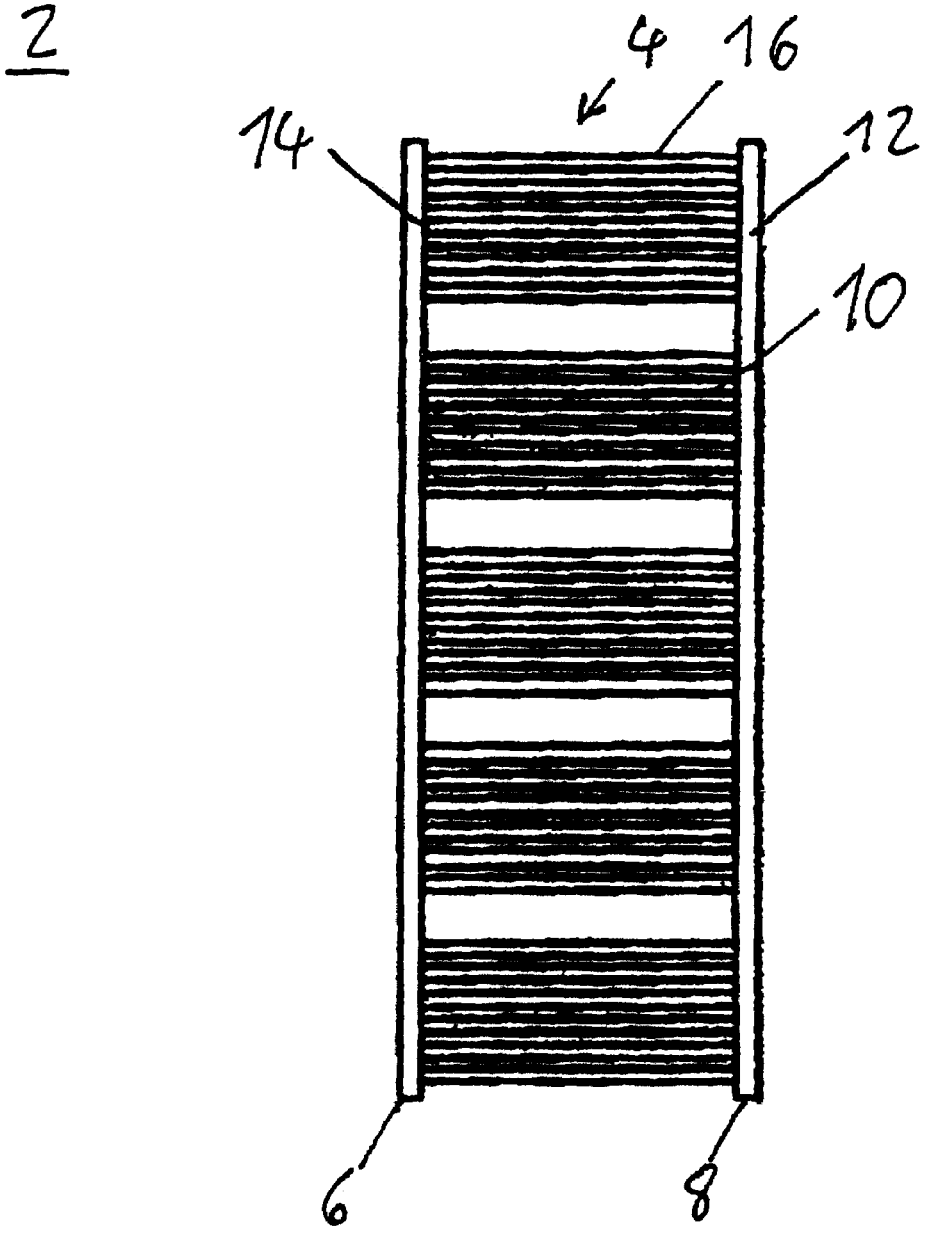
FIG. 1 shows a perspective view of an invented towel dryer.

The invented towel dryer 2 has a base body 4 and two connection fittings 6, 8 connecting respectively to an inlet line for water supply and to an outlet line for the removal of the used water. The external inlet and outlet lines are not shown. The base body 4 has two parallel running tubes 12, 14, which are distanced from one another by the crossover tubes 16. With this arrangement, the water can flow between the two tubes 12, 14, so that, for example, hand towels (not shown) can be hung on the crossover tubes 16 to be dried.

In accord with the invention, the base body requires no surface coating for the attainment of the desired degree of reflectivity, but rather the surface is worked in such a manner, that both the aesthetic total impression of the heating body 2 is increased and the base body is also protected against corrosion and damage.

In a preferred embodiment, the surface possesses a degree of reflectivity of 80% to 100%.

As an aid for the judgment of the luster of the finish, a reflectometer is applicable, which is in accord with DIN 67 530.

An essential advantage of the invented towel dryer 2 is, that in comparison to conventional chromed steel towel dryers, it possesses an improved degree of heat transfer. For example, of a chromed heating body, the statement is made, that a heat load of some 750 W is developed. Contrary to this, an equally sized aluminum towel dryer 2 develops a heating load of about 1100 W. That is to say, the invented towel dryer 2 possesses, size for size, about a 50% greater heat production, whereby its high heat transfer capability permits a quicker reaction for the input and output control, such as, for example, might be called for by thermostatic regulation. Such an advantage can markedly reduce the heating costs.

The metal base body 4 of the towel dryer 2, in keeping with the invention, is mechanically ground for the achievement of the desired degree of reflectivity, then mechanically polished and chemically (electro-chemically) brought to a high reflectivity.

The mechanical abrasive treatment is mostly done by rough grinding for the removal of gross protrusions and depressions of the surface 10. This is generally carried out by a grinding disk. In general dry grinding is employed, whereby the circumferential speed is held to within a range of 420 to 1200 RPM.

After the rough grinding, then a secondary grinding takes place. For this operation, advantageously, a grinding disk arrangement is again used wherein the laminated disks are impregnated with special clay. The 60 to 120 mesh clay is impregnated into a fabric which can be of cloth, sheepskin, or muslin. The disks may turn within a range of 1500 to 1800 RPM. However, even a rotation speed up to 3000 RPM may be used.

Subsequent to the secondary grinding, fine abrasive treatment takes place. This can also be known as pre-polishing. Normally, the disks for this purpose, as described above, can be of felt, sheepskin or bias cut muslin fabric with impregnated 100 to 200 mesh clay. The operation is cooled by air flow. The circumferential speed lies somewhere in the ranges as given above, although it may be slightly increased.

After the mechanical grinding, the surface 10, for the removal of abrasion traces, and for the acquiring of a luster, is similarly mechanically treated, this time with a polishing disk. The polishing disk possesses more laminations, preferably of loose or battened cotton material and turns at some 2000 to 2600 RPM. This polishing is optionally carried out dry or wet. In order that the hardness of the polishing disk may be changed, it is possible, that among other changes of a fiber count of the cotton material, also cloth, wood or paper insertions may be interposed between the individual disks.

Care must be taken, in regard to the mechanical polishing of the invented towel dryer, that, in particular, no metal particulate are to be allowed to adhere to the polishing disks, since such inserts, without fail, lead to a lessening of the surface quality.

Fundamentally, attention must be given during the mechanical grinding and polishing, that no excessive temperatures are generated and no gouging of the surface takes place. A protection of such temperature can be brought about, for the safety of the surface, by an appropriate choice of the speed of rotation, pressure of the abrasive means, as well as by means of proper design of the said disks or by the use of abrasive or polishing means such as greases, oil or pastes.

By the employment of abrasive and/or polishing means, the impingement of these materials in the surface 10 is to be avoided, since such embedded materials can be released during the next process step and thus impair the quality of the surface 10.

Further, in a case of large towel dryers 2 with greater surfaces 10, it can be of advantage, to replace the grinding disks with abrasive belts.

For the achievement of a final luster, the surface 10 is treated, after the mechanical phase, chemically or electrochemically. Preference is given to the chemical treatment, since such a procedure, counter to the electrochemical method, such as, for instance, the Erft-works process has the advantage, that no electrical energy is required. In this way, instead of electrical current, oxidizing agents are used.

Advantageously, the surface 10 is finally electrochemically anodized, or treated with Eloxal, so that the resistance to corrosion of the said surface is increased by an Eloxal-coating. This is especially valuable, if the heating body 2 is to be used in rooms subject to high humidity, such as, for example, bathrooms or, as mentioned above, the heating body is to be used for the drying of towels.

By the above, the surface 10 is chemically changed, so that a porous aluminum oxide layer is formed, which is still to be sealed in a final step of the process.

It is also possible, that the surface 10, instead of being coated with the Eloxal layer, receives a finish of a clear lacquer for the increase of the resistance to corrosion. In this case, the lacquer coating can be applied by spraying, or in the form of a powder, or by means of a fine brush, or the lacquer can be applied by dipping into an immersion bath.

Disclosed is a towel dryer with a base body of metal, preferably aluminum or high quality steel, the surface of which, is caused to be of high reflectivity and resistant to corrosion.

REFERENCE NUMBERS AND CORRESPONDING COMPONENTS

2 Towel dryer
4 Base body
6 Connection fitting
8 Connection fitting
10 Surface
12 Parallel tube
14 Parallel tube
16 Crossover tube(s)

The invention claimed is:

1. A towel dryer comprising an aluminum body, the body comprising a surface configured to contact and transfer heat to a towel to be dried, the surface having a degree of reflectance not less than 80%, and a clear lacquer coat on the aluminum surface.

* * * * *